United States Patent [19]

Gwyn

[11] 4,279,733

[45] Jul. 21, 1981

[54] COKING PREVENTION

[75] Inventor: John E. Gwyn, Katy, Tex.

[73] Assignee: Shell Oil Company, Houston, Tex.

[21] Appl. No.: 106,060

[22] Filed: Dec. 21, 1979

[51] Int. Cl.[3] ..... C10G 9/16

[52] U.S. Cl. ..... 208/48 R; 208/48 Q; 208/128; 208/130; 585/648

[58] Field of Search ..... 208/48 R, 48 Q, 128–130; 585/648

[56] References Cited

U.S. PATENT DOCUMENTS

| | | | |
|---|---|---|---|
| 2,754,340 | 7/1956 | Anderson et al. | 208/48 Q |
| 2,775,629 | 12/1956 | Anderson | 208/48 Q |
| 2,901,418 | 8/1959 | Pappas | 208/48 Q |
| 3,498,906 | 3/1970 | Bogart et al. | 208/50 |
| 3,878,088 | 4/1975 | Nahas et al. | 208/50 |
| 3,907,661 | 9/1975 | Gwyn et al. | 208/48 Q |

*Primary Examiner*—Delbert E. Gantz
*Assistant Examiner*—G. E. Schmitkons

[57] ABSTRACT

A method for reducing coking in quench units is disclosed, the method being characterized by removal of the coking materials from the quench liquid employed.

2 Claims, 2 Drawing Figures

COKING PREVENTION

BACKGROUND OF THE INVENTION

Pyrolysis of a liquid hydrocarbon material is a well-known process that involves heating the material to a temperature that is high enough to cause thermal decomposition of larger molecules to form smaller molecules. Pyrolysis may be accomplished with a diluent, such as steam, to produce more favorable product distribution. A pyrolysis process produces a highly unsaturated and very unstable product, hereinafter called the effluent from the pyrolysis process, or simply the effluent.

The effluent is usually rich in olefins, diolefins, acetylenes and other highly unstable compounds, and there is a strong tendency for these materials to react to form high molecular weight products which may be identified collectively as coke or tar. Such products are not desirable and to avoid forming them it is essential to reduce the temperature of the effluent quickly to a stable temperature, that is, to a temperature that is so low that rapid reactions of unstable compounds with each other do not take place.

My copending application, U.S. Ser. No. 106,291, filed even date herewith, describing an invention entitled Quench Process, and which disclosure is incorporated herein by reference, describes an efficient process for recovering heat, particularly as high grade steam. That process has the advantage that inexpensive quench liquids, such as pitch, fractionator bottoms, etc., may be employed as quench liquid. However, because such materials may contain coke and high molecular products which might tend to form coke, and because the pyrolysis effluent does contain such materials, it may be desirable to provide a method to prevent buildup of such materials in the quench system. The invention provides such a method.

SUMMARY OF THE INVENTION

Accordingly, the invention, in one embodiment, relates to a process comprising:

(a) quenching the effluent from a hydrocarbon pyrolysis zone with a quench liquid, and producing a quenched effluent and quench liquid having a temperature not less than about 370° C.;

(b) passing the quenched effluent and at least the bulk of the quench liquid as a feed to a fractional distillation zone, and fractionally distilling the feed;

(c) continuously removing a bleed stream containing a bottoms fraction of the fractional distillation zone;

(d) contacting said fractionator bottoms stream with a light aromatic hydrocarbon liquid to produce a mixture of light aromatic hydrocarbon and fractionator bottoms, and insoluble materials;

(e) removing the insoluble materials from the mixture of light aromatic hydrocarbon liquid, fractionator bottoms and insoluble materials, to produce a quench liquid mixture containing fractionator bottoms and light aromatic hydrocarbons;

(f) passing the quench liquid mixture to the quench zone of step (a), and employing the quench liquid mixture as the quench liquid of step (a).

In another embodiment, the invention comprises:

(a) quenching the effluent from a hydrocarbon pyrolysis reactor by contacting the effluent in a quench zone with a quench liquid, and producing a quenched effluent and quench liquid mixture having a temperature not less than 370° C.;

(b) separating at least a portion of the quench liquid from the quenched effluent and quench liquid mixture;

(c) contacting the quench liquid from step (b) with a light aromatic hydrocarbon liquid to produce a mixture of light aromatic hydrocarbon liquid and quench liquid, and insoluble materials;

(d) removing the insoluble materials from the mixture of light aromatic hydrocarbon liquid, quench liquid and insoluble materials to produce a quench liquid containing light aromatic hydrocarbon liquid and quench liquid;

(e) passing the quench liquid to the quench zone of step (a), and employing the quench liquid as the quench liquid of step (a).

The temperature of the effluent from the pyrolysis unit will normally exceed 760° C., temperatures on the order of from 780° C. to 800° C. being common. In accordance with the disclosure of my copending application, the effluent may first be contacted in a pre-cooling zone to lower the temperature of the effluent to a range of from about 650° C. to 540° C., preferably not below 590° C. The high quality present in the effluent may be utilized, by indirect heat exchange, e.g., to produce high pressure steam. The partially cooled effluent, with a significant heat content extracted, is then passed to a quench zone. The quench zone comprises a two section quench unit, as disclosed in my aforementioned copending application.

More particularly, the effluent is cooled in the quench zone to a temperature not lower than about 370° C. This is accomplished by suitable quench liquid temperature and volume, and by appropriate design of the quench zone, as particularly provided in my aforementioned copending application. In addition to the continuous film of quench liquid on the heat exchange surface, as described in U.S. Pat. No. 3,907,661, to Gwyn, Baldwin, and Brodhead, issued Sept. 23, 1975, the quench liquid is preferably sprayed into the effluent at or prior to the entry of the quenching heat exchanger. This procedure is preferred in order to insure rapid quenching, thereby preventing local hot spots which would promote dry surfaces and attendant coking.

The quench liquid employed may vary in composition, subject to the requirement that it does not completely vaporize at the temperatures employed for quenching and the unvaporized portion remains liquid. Suitable hydrocarbonaceous liquids must be compatible with the effluent, and normally will include such highly aromatic liquids as aromatic residual oils, gas oils, etc. Fractionator bottoms and pyrolysis pitch represent preferred materials. Those skilled in the art, given the requirements set forth herein, may select the appropriate quench liquid with little difficulty.

As indicated, in one embodiment of the invention, the effluent and quench liquid are passed to a fractional distillation zone for separation of the effluent into desired products. In another embodiment, prior to the entry into the fractional distillation zone, at least a portion of the quench liquid may be separated from the effluent. Preferably, at least a portion of the quench liquid is separated from the mixture issuing from the quench zone before entry of such mixture in the fractional distillation zone. The effluent, and any remaining quench liquid, may be cooled before entry into the fractional distillation zone. Procedures employed in fractionating such effluents are known in the art, and form no part of the invention.

As noted, the fractionator bottoms represents a preferred quench material for the liquid quench. Accordingly, a bleed stream is removed for return to the quench zone. However, to prevent buildup of tars and coke in the quench liquid or reduce the possibility of coking in the quench zone, the bleed stream is first contacted with a suitable aromatic hydrocarbon to reject insoluble materials. The stream may be cooled to prevent vaporization of the aromatic hydrocarbons. The insolubles may then be removed, for example, by filtration or centrifugation. The liquid is then suitable for use as a quench liquid. Similarly, if portion of the quench liquid is separated from the mixture issuing from the quench zone (such as in a knockout drum), at least a portion thereof may be treated with the light aromatic hydrocarbon to remove insolubles.

The composition of the aromatic hydrocarbon liquid utilized for rejecting the tars, etc., may be varied widely. In general, light aromatic hydrocarbon liquids, normally mixtures of light aromatic hydrocarbons, may be employed. The aromatic materials may then be recovered as part of a gasoline fraction from the fractionation column. In general, streams containing benzene, toluene, or aromatic gasoline fractions are preferred. A preferred source of such materials is, of course, a bleed stream from the fractionation column employed. The ratio of light aromatic hydrocarbon to quench liquid may be varied widely, it being necessary only to supply such volumes of aromatic liquid as to precipitate the coke. In general, ratios of 2 to 5 of light aromatic hydrocarbon to quench liquid may be used, with ratios of 3 to 4 being preferred.

BRIEF DESCRIPTION OF DRAWING

In order to demonstrate the invention, reference is made to the accompanying drawing.

In FIG. 1, line 10 supplies a suitable hydrocarbon feed, such as gas oil, to a pyrolysis zone shown schematically as zone 11 wherein the hydrocarbon is subjected to conditions that cause thermal decomposition with the production of a variety of unstable products. The pyrolysis product or effluent passes from the pyrolysis zone through line 12 for recovering and processing. The effluent may be subjected to immediate heat recovery, as described in my copending application, or passed on to full quench. The invention contemplates preliminary heat recovery, with the temperature in the liquid quench zone not dropping below 370° C. To that end, the effluent is passed through heat exchange zone 13 where it is cooled to a temperature of not less than about 540° C., and then passed, via line 14 to quench zone 15. The two-section quench-zone configuration, as disclosed in my aforementioned copending application is preferred, the drawing herein being merely diagrammatic. In quench zone 15, a liquid quench medium is introduced in a manner to cool the effluent and maintain the walls of quench zone 15 wet, the liquid quench medium being supplied through line 16. From quench zone 15 the effluent and quench liquid pass through line 17 into fractionator 18. In fractionator 18, the stabilized effluent is separated into fractions according to boiling ranges, the lowest boiling materials being removed through line 19, and intermediate range materials such as gasoline, gas oils, etc., being removed in lines 20 through 22. A bottom fraction is removed through line 23. A part of the heavy gas oil from line 22 may be returned to zone 15 as quench liquid (not shown). The bottom fraction from column 18 may be recovered through line 23.

Figure 1:
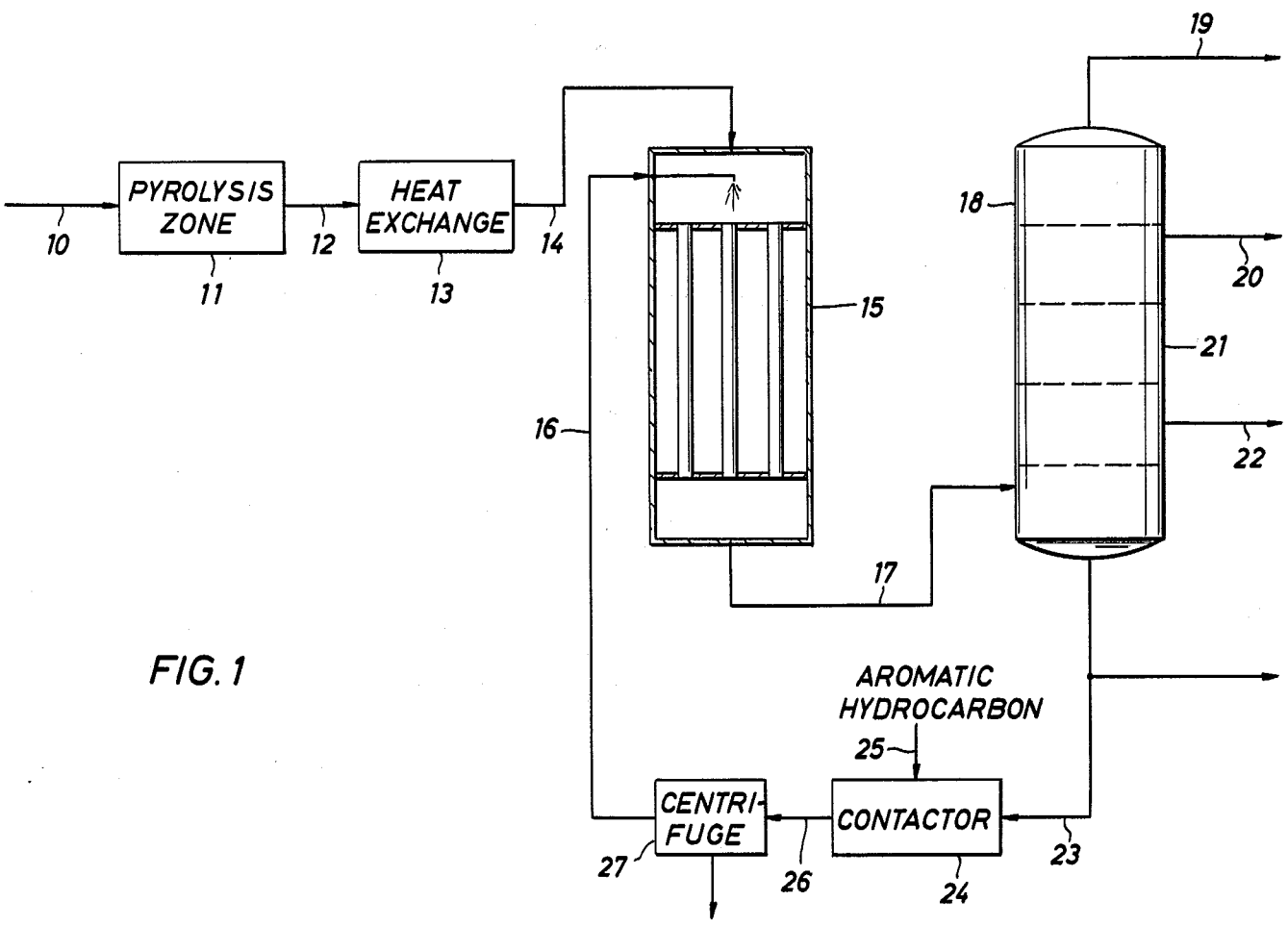
FIG. 1 is a schematic representation of one embodiment of the invention in which the use of a bleed stream from a fractionator bottoms is illustrated, while FIG. 2, also schematic, illustrates an embodiment in which at least a portion of the used quench liquid is not sent to the fractionator, but is separated and combined with a light aromatic hydrocarbon liquid, with insolubles then being removed.

From line 23, the fractionator bottoms stream flows to contactor 24 wherein the bottoms are contacted with a light aromatic hydrocarbon fraction, such as from line 20, via line 25. The stream may be cooled prior to contacting (not shown), in order to reduce the vaporization of the light aromatic hydrocarbon. Contactor 24 does not have to be a separate unit; the fraction may be injected in line 23. In any event, tars, etc., tend to precipitate from the bottoms liquid, and the combined streams are passed through line 26 to a centrifuge 27 wherein the insolubles are removed. The quench liquid is then passed via line 16 to quench zone 15. The utilization of the light aromatic hydrocarbon has the added advantage of providing additional moderation in the quench zone.

Figure 2:
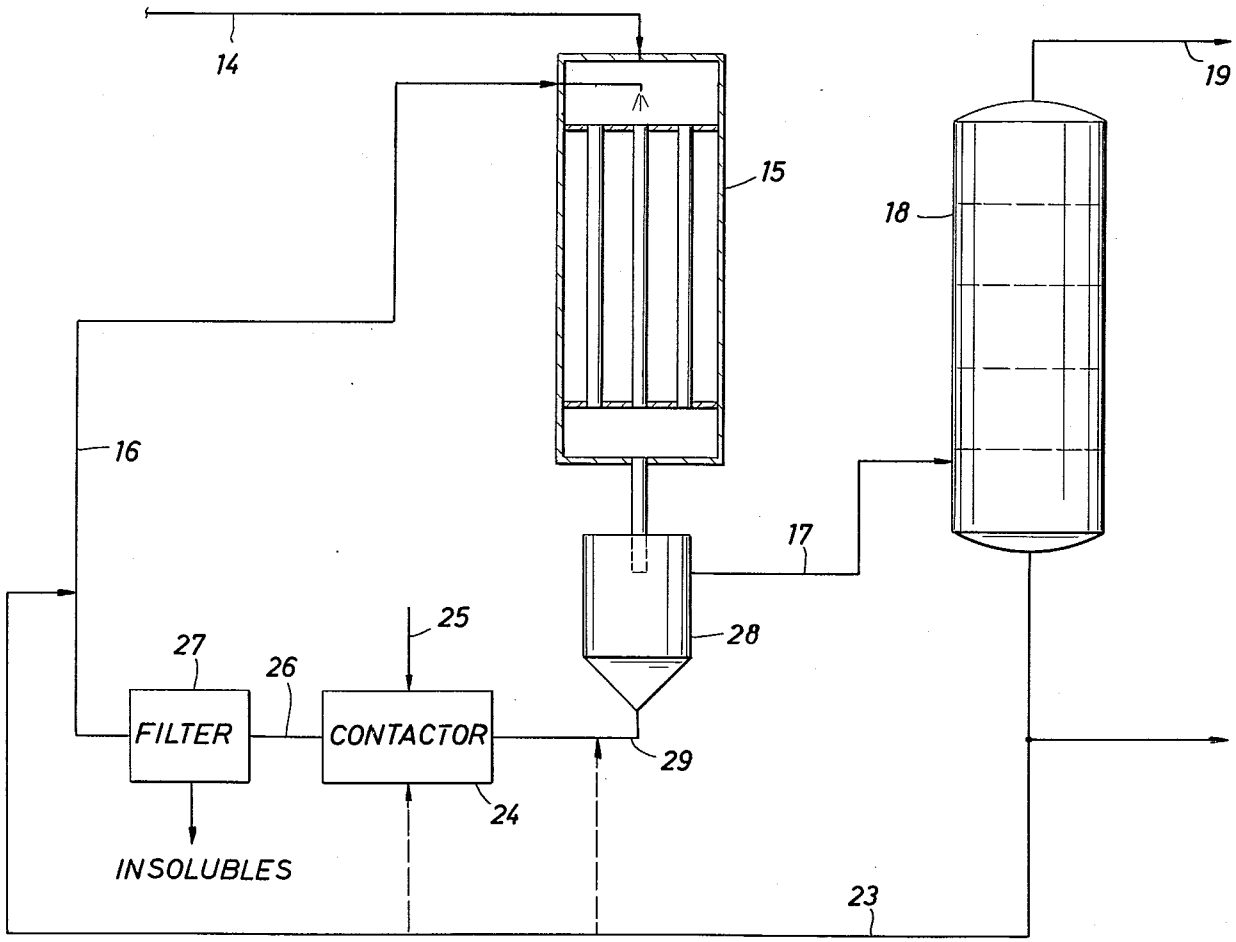

The embodiment of FIG. 2 provides both flexibility and direct recycle of quench liquid. Similar numbers refer to similar elements of FIG. 1. In this embodiment, at least a portion, preferably the bulk, of the quench liquid is separated from the effluent, after quench unit 15, in a knockout drum 28. The quench liquid then passes via line 29 to contactor 24 wherein it is contacted with a light aromatic fraction from line 25. As in FIG. 1, the quench liquid may be cooled before contacting. Recycle or make-up liquid from fractionator 18 may be added prior to or during entry into contactor 24 (dotted lines). As in the previous embodiment, contactor 24 does not have to comprise separate equipment, and 27 may be a filter instead of a centrifuge. The quench liquid is then passed via line 16 to quench zone 15. Quench liquid in line 23 may be added to line 16 prior to entry into quench zone 15.

While the invention has been illustrated with respect to particular apparatus, those skilled in the art will appreciate that other equivalent or analogous units may be employed. Again all pumps, valves, etc. have not been illustrated, as such expedients can readily be supplied by the skill of the art.

What is claimed is:

1. A process comprising (a) quenching the effluent from a hydrocarbon pyrolysis reactor by contacting the effluent in a quench zone with a quench liquid, and producing a quenched effluent and quench liquid having a temperature not less than 370° C.;

(b) passing the quenched effluent and at least the bulk of the quench liquid as a feed to a fractional distillation zone, and fractionally distilling the feed;

(c) continuously removing a bleed stream containing a bottoms fraction of the fractional distillation zone;

(d) contacting said fractionator bottoms bleed stream with a light aromatic hydrocarbon liquid to produce a mixture of light aromatic hydrocarbon and fractionator bottoms, and insoluble materials;

(e) removing the insoluble materials from the mixture of light aromatic hydrocarbon liquid, fractionator bottoms and insoluble materials, to produce a quench liquid mixture containing fractionator bottoms and light aromatic hydrocarbons;

(f) passing the quench liquid mixture to the quench zone of step (a), and employing the quench liquid mixture as the quench liquid of step (a).

2. A process comprising (a) quenching the effluent from a hydrocarbon pyrolysis reactor by contacting the effluent in a quench zone with a quench liquid, and producing a quenched effluent and quench liquid mixture having a temperature not less than 370° C.;

(b) separating at least a portion of the quench liquid from the quenched effluent and quench liquid mixture;

(c) contacting the quench liquid from step (b) with a light aromatic hydrocarbon liquid to produce a mixture of light aromatic hydrocarbon liquid and quench liquid, and insoluble materials;

(d) removing the insoluble materials from the mixture of light aromatic hydrocarbon liquid, quench liquid and insoluble materials to produce a quench liquid containing light aromatic hydrocarbon liquid and quench liquid;

(e) passing the quench liquid to the quench zone of step (a), and employing the quench liquid as the quench liquid of step (a).

* * * * *